US010208364B2

(12) United States Patent
Okada et al.

(10) Patent No.: US 10,208,364 B2
(45) Date of Patent: Feb. 19, 2019

(54) NI-BASED ALLOY, NI-BASED ALLOY FOR GAS TURBINE COMBUSTOR, MEMBER FOR GAS TURBINE COMBUSTOR, LINER MEMBER, TRANSITION PIECE MEMBER, LINER, AND TRANSITION PIECE

(71) Applicant: Hitachi Metals, Ltd., Tokyo (JP)

(72) Inventors: Ikuo Okada, Takasago (JP); Masaki Taneike, Takasago (JP); Hidetaka Oguma, Takasago (JP); Yoshitaka Uemura, Takasago (JP); Daisuke Yoshida, Takasago (JP); Yoshiyuki Inoue, Takasago (JP); Masato Itoh, Kitamoto (JP); Kenichi Yaguchi, Kitamoto (JP); Tadashi Fukuda, Kitamoto (JP); Takanori Matsui, Kitamoto (JP)

(73) Assignee: Hitachi Metals, Ltd., Tokyo (JP)

( * ) Notice: Subject to any disclaimer, the term of this patent is extended or adjusted under 35 U.S.C. 154(b) by 294 days.

(21) Appl. No.: 14/910,106

(22) PCT Filed: Aug. 6, 2014

(86) PCT No.: PCT/JP2014/070795
§ 371 (c)(1),
(2) Date: Feb. 4, 2016

(87) PCT Pub. No.: WO2015/020117
PCT Pub. Date: Feb. 12, 2015

(65) Prior Publication Data

US 2016/0177423 A1 Jun. 23, 2016

(30) Foreign Application Priority Data

Aug. 6, 2013 (JP) ..... 2013-163524

(51) Int. Cl.
*C22C 19/05* (2006.01)
*C22F 1/00* (2006.01)
(Continued)

(52) U.S. Cl.
CPC ..... *C22C 19/055* (2013.01); *C22C 19/05* (2013.01); *C22F 1/00* (2013.01); *C22F 1/10* (2013.01); *F23R 3/002* (2013.01); *F23R 3/60* (2013.01)

(58) Field of Classification Search
CPC ..... C22C 19/055
See application file for complete search history.

(56) References Cited

U.S. PATENT DOCUMENTS 4,474,733 A 10/1984 Susukida et al.
4,629,521 A 12/1986 Maurer et al.
(Continued)

FOREIGN PATENT DOCUMENTS

EP 2 009 123 A1 12/2008
EP 2 330 225 A1 6/2011
(Continued)

OTHER PUBLICATIONS

International Search Report, PCT/JP2014/070795, dated Nov. 11, 2014, 2 pages.
(Continued)

*Primary Examiner* — Colleen P Dunn
*Assistant Examiner* — Rajinder Bajwa
(74) *Attorney, Agent, or Firm* — Myers Bigel, P.A.

(57) ABSTRACT

A Ni-based alloy comprises nitrides, of which an estimated largest size is an area-equivalent diameter of 12 μm to 25 μm, the estimated largest size of the nitrides being determined by calculating an area-equivalent diameter D which is defined as $D=A^{1/2}$ in relation to an area A of a nitride with a largest size among nitrides present in a measurement field
(Continued)

of view area $S_0$ of an observation of the Ni-based alloy, repeatedly performing this operation for n times corresponding to a measurement field of view number n to acquire n pieces of data of the area-equivalent diameter D, arranging the pieces of data of area-equivalent diameter D in ascending order into $D_1$, $D_2$, . . . $D_n$ to calculate a standardized variable $y_j$, plotting the area-equivalent diameter D and the standardized variable $y_j$ on X and Y axes of an X-Y coordinate system, respectively, to obtain a regression line $y_j=a\times D+b$ (wherein a and b are constants) to calculating $y_j$ where a cross-sectional area to be predicted S is 100 $mm^2$, and substituting the obtained value of $y_j$ into the regression line to obtain the estimated largest size of the nitrides.

9 Claims, 2 Drawing Sheets

(51) Int. Cl.

| | |
|---|---|
| ***C22F 1/10*** | (2006.01) |
| ***F23R 3/00*** | (2006.01) |
| ***F23R 3/60*** | (2006.01) |

(56) References Cited

U.S. PATENT DOCUMENTS

| | | | | |
|---|---|---|---|---|
| 6,551,371 | B1 * | 4/2003 | Furuta | C22C 14/00 419/12 |
| 2005/0191482 | A1 * | 9/2005 | Liu | C22C 29/005 428/323 |
| 2009/0136382 | A1 * | 5/2009 | Matsui | C22C 19/056 420/449 |
| 2013/0263977 | A1 * | 10/2013 | Rickenbacher | B05D 3/06 148/540 |

FOREIGN PATENT DOCUMENTS

| | | | |
|---|---|---|---|
| JP | 58-110650 | A | 7/1983 |
| JP | 61-139633 | A | 6/1986 |
| JP | S61-34497 | B2 | 8/1986 |
| JP | H10-68035 | A | 3/1998 |
| JP | 2005-265544 | A | 9/2005 |
| JP | 2005-274401 | A | 10/2005 |
| JP | 2009-185352 | A | 8/2009 |
| JP | 2013-049902 | A | 3/2013 |
| WO | WO 2007/119832 | A1 | 10/2007 |
| WO | WO 2013/118750 | A1 | 8/2013 |

OTHER PUBLICATIONS

Communication with Supplementary European Search Report, EP Application No. 14835088.7, dated Mar. 14, 2017, 12 pages.

Alexandre et al., "Modelling the optimum grain size on the low cycle fatigue life of a Ni based superalloy in the presence of two possible crack initiation sites", *Scripta Materialia*, vol. 50, No. 1, Oct. 3, 2003, pp. 25-30.

Decision of Refusal with English language translation, JP Application No. 2013-163524, dated Feb. 5, 2018, 11 pages.

* cited by examiner

NI-BASED ALLOY, NI-BASED ALLOY FOR GAS TURBINE COMBUSTOR, MEMBER FOR GAS TURBINE COMBUSTOR, LINER MEMBER, TRANSITION PIECE MEMBER, LINER, AND TRANSITION PIECE

RELATED APPLICATIONS

This application is a 35 U.S.C. § 371 national phase application of PCT Application PCT/JP2014/070795 filed Aug. 6, 2014, which claims priority to Japanese Application No. 2013-163524 filed Aug. 6, 2013, the contents of which are incorporated herein by reference in their entireties.

TECHNICAL FIELD

The present invention relates to a Ni-based alloy with excellent high-temperature strength and high-temperature corrosion resistance characteristics, and to a Ni-based alloy for gas turbine combustor, a member for gas turbine combustor, a liner member and a transition piece member for gas turbine combustor, and a liner and a transition piece for gas turbine combustor, each of which is made of the Ni-based alloy mentioned above.

The present application claims priority from Japanese Patent Application No. 2013-163524 filed in Japan on Aug. 6, 2013, which is incorporated herein by reference in its entirety.

BACKGROUND ART

Ni-based alloys have been widely applied as materials for members used in aircraft, gas turbines and the like, as disclosed by Patent Documents 1 to 3, for example.

In a gas turbine, a combustor is arranged at the back of a compressor and at a location closer to the periphery hereof, which functions to inject fuel into air discharged from the compressor, generate high-temperature and high-pressure gas for driving the turbine by combusting the fuel, and guide the fuel gas into nozzles (vanes) arranged at the inlet of the turbine, i.e., gas turbine combustors are used in high temperature environments.

In particular, the liner (inner cylinder) and the transition piece (tail pipe) among members and parts of a combustor are exposed to high-temperature combustion gases. In addition, the liner and the transition piece are subjected to frequent heating/cooling cycles in which heating and cooling are very frequently repeated for starting, stopping, and controlling the outputs of the gas turbine.

To consider the use conditions mentioned above, it is desired that Ni-based alloys used for the combustor and the like of gas turbines have high-temperature strengths such as high-temperature tensile strength, creep rupture strength, low-cycle fatigue strength, and thermal fatigue strength, excellent high-temperature corrosion resistance such as high-temperature oxidation or sulfurization resistance, and high cold workability, machinability, weldability, brazing characteristics. Similarly in aircraft and the like, the above-described use environment applies, and thus, the characteristics described above are required.

In such Ni-based alloys, in order to secure the above-described characteristics, it is required to strictly control the composition components and the metal structure, and also stocks to be charged are highly restricted. These restrictions are applied because the above-described characteristic may reduce due to the presence of inclusions in a Ni-based alloy such as nitrides and oxides. In particular, nitrides have been known to more remarkably influence various characteristics as their size becomes larger, and nitrides in which Ti is included as the main component of the metal components have been recognized to be harmful. Specifically, nitrides may become initiation points of cracks occurring due to creeps and creep fatigues caused during the use of gas turbines and thus reduce the life of Ni-based alloy members, and also considerably reduce the life of tools due to abnormal wear and chippings of cutting tools that occur during cutting.

In this regard, for example, Patent Document 2 discloses that the amount of nitrogen present in a Ni-based alloy should be confined to 0.01% by mass or less.

Patent Document 3 discloses that the maximum particle size of carbides and nitrides should be confined to 10 μm or less. It is pointed out that if the particle size of carbides and nitrides exceeds 10 μm, cracks may occur from the interface between the carbides or nitrides and the matrix phase during working at room temperature.

Furthermore, it is known in the field of iron and steel industry that a method for evaluating inclusions in Fe—Ni alloys such as Fe-36% Ni alloy and Fe-42% Ni alloy is carried out by estimating the maximum particle size of nonmetal inclusions, especially oxides, as disclosed in Patent Documents 4 and 5.

CITATION LIST

Patent Document

[Patent Document 1] JP S61-034497 B
[Patent Document 2] JP S61-139633 A
[Patent Document 3] JP 2009-185352 A
[Patent Document 4] JP 2005-265544 A
[Patent Document 5] JP 2005-274401 A

SUMMARY OF INVENTION

Technical Problem

However, Patent Document 2 discloses that the upper limit value of nitrogen amount is controlled, but the control of nitrogen amount is not linked with the maximum particle size of nitrides, and thus, there may be a problem that a Ni-based alloy having a sufficiently high fatigue strength cannot be securely obtained even if the nitrogen amount is reduced.

In addition, Patent Document 3 discloses that the maximum particle size of nitrides is controlled to be 10 μm or less, but Ni-based alloys are essentially required to have very high cleanliness factors because they are used for parts of aircraft and gas turbines for power generation, and thus, it is actually difficult to grasp the maximum particle size by observing all the portions. The particle sizes of carbides are measured in the examples of Patent Document 3, and in this point also, it is suggested that it is difficult to grasp the maximum particle size of nitrides. Also, in order to predict the maximum particle size of nitrides, distribution of the maximum particle size of the nitrides in the field of view for the actual measurement is important, but Patent Document 3 is silent on this point and fails to disclose any prediction of an estimated maximum particle size of nitrides.

In Patent Documents 4 and 5, subjects of measurement are oxides, which particularly tend to have a large particle size among Fe—Ni alloys in which a large amount of relatively large non-metal inclusions is precipitated, and it is very difficult to estimate the maximum particle size of nitrides to improve the fatigue strength of Ni-based alloys, which requires us to perform various examinations. In addition, in Ni-based alloys, the oxygen amount and the nitrogen amount have been reduced by vacuum melting and remelting, and thus the number of nonmetal inclusions is less and the sizes of such nonmetal inclusions are smaller than those included in steel materials. Further, because Ni-based alloys includes a variety of phases, separation of light emission patterns and observation of nonmetal inclusions cannot be performed similarly to those carried out in the field of iron and steel.

Accordingly, even if the methods performed in the field of iron and steel are merely applied, the relationship between nitrides included in a Ni-based alloy and the fatigue strength of the Ni-based alloy cannot be sufficiently evaluated.

In addition, because the above-described Ni-based alloys include a large amount of metals known as minor metals to secure their characteristics, it is difficult to stably secure stocks. Accordingly, for the above-described Ni-based alloys, it is desired to enhance recycling of scraps. However, should the amount of use of scraps be increased, a large amount of inclusions may be generated due to possible contamination by elements of impurities and the like. Accordingly, means for evaluating inclusions in Ni-based alloys with a high accuracy is desired.

The present invention has been devised in consideration of the circumstances described above. The inventors have completed the present invention based on the knowledge such that the maximum particle size of nitrides included in a Ni-based alloy greatly influences the fatigue strength of the alloy and based on the results of examinations of a relationship between estimated largest sizes of nitrides in the area of the cross sections for prediction and the fatigue strength, performed because it is actually difficult to observe all cross sections of the subject material.

An object of the present invention is to provide a Ni-based alloy with excellent high-temperature strength properties and high-temperature corrosion resistance, a Ni-based alloy for gas turbine combustor, a member for gas turbine combustor, a liner member and a transition piece member for gas turbine combustor, and a liner and a transition piece for gas turbine combustor, each of which is made of the Ni-based alloy mentioned above.

Solution to Problem

In order to solve the problems discussed above, a Ni-based alloy according to the present invention has a composition including, by mass, 20.0% to 26.0% Cr, 4.7% to 9.4% Co, 5.0% to 16.0% Mo, 0.5% to 4.0% W, 0.3% to 1.5% Al, 0.1% to 1.0% Ti, 0.001% to 0.15% C, and at most 5% Fe; and includes nitrides, of which an estimated largest size is an area-equivalent diameter of 12 μm to 25 μm, the estimated largest size of the nitrides being determined by calculating an area-equivalent diameter D which is defined as $D=A^{1/2}$ in relation to an area A of a nitride with a largest size among nitrides present in a measurement field of view area $S_0$ of an observation of the Ni-based alloy, repeatedly performing this operation for n times corresponding to a measurement field of view number n to acquire n pieces of data of the area-equivalent diameter D, arranging the pieces of data of area-equivalent diameter D in ascending order into $D_1, D_2, \ldots D_n$ to calculate a standardized variable $y_j$ which is defined by the following expression:

$$y_j=-\ln[-\ln\{j/(n+1)\}] \quad \text{[Expression 1]}$$

wherein j denotes the number of the arranged ascending order of the data of the area-equivalent diameter D, plotting the area-equivalent diameter D and the standardized variable $y_j$ on X and Y axes of an X-Y coordinate system, respectively, to obtain a regression line $y_j=a\times D+b$ (wherein a and b are constants), calculating $y_j$ from the following expression:

$$y_j=-\ln\left(-\ln\frac{S}{S_0+S}\right) \quad \text{[Expression 2]}$$

where a cross-sectional area to be predicted S is 100 $mm^2$, and substituting the obtained value of $y_j$ into the regression line to obtain the estimated largest size of the nitrides.

According to the Ni-based alloy of present invention having the above-described configuration, when the cross-sectional area to be predicted S is 100 $mm^2$, the estimated largest size of the nitrides is an area-equivalent diameter of 25 μm or less, and thus, no large-size nitrides exist inside the Ni-based alloy, thereby enabling improvement of mechanical properties (fatigue property) of the Ni-based alloy. In addition, early degradation of tools that may occur during machining can be prevented.

In order to control the area-equivalent diameter for the estimated largest size to be less than 12 μm, it is necessary that the dwell time of Ti in the molten metal during a melting process be reduced to impart a high solidification rate in a solidifying process. It may dramatically increase the production costs due to the conditions that raw materials to be used should be limited for restriction of charge timing of Ti, that the permissible temperature range may become narrow, and that the casting material may become small. In order to avoid these problems, according to the present invention, the estimated largest size of the nitrides is set 12 μm or more in terms of the area-equivalent diameter.

The observation of the nitrides is preferably carried out by a magnification of 400 to 1,000 times at the number of measurement fields of view n of 30 or more. The measurement of the area of nitride is preferably carried out by acquiring the luminance distribution by image processing to determine a threshold for the luminance, and distinguishing the nitrides from the matrix phase, the carbides and the like to measure the area of nitride. In this measurement, color difference (RGB) may be used instead of the luminance.

Nitrides include crystallized nitrides and precipitated nitrides, the former being produced from a liquid phase during a solidifying process of a molten metal, and the latter being produced from a solid phase that has been solidified once. Crystallized nitrides and precipitated nitrides are different from each other in that the precipitated nitrides may greatly vary in size because the nitrides are dissolved in the matrix and are re-precipitated during a hot working or heat treatment process after a melting process, whereas the size of crystallized nitrides, which is obtained at a solidification stage during a melting process, is basically maintained regardless of a hot working or heat treatment process performed after the solidification. In general, compared with the precipitated nitrides, the crystallized nitrides easily become larger in size, and thus, the crystallized nitrides have a highly harmful effect on the fatigue strength or the like. According to the present invention, the crystallized nitrides may be targeted as the nitride with largest size for calculating the area-equivalent diameter D.

In addition, there can be provided a high-quality Ni-based alloy having an excellent high-temperature corrosion resistance, excellent high-temperature strength properties such as creep properties and creep fatigue, and an excellent workability because the Ni-based alloy has a composition including, by mass, 20.0% to 26.0% Cr, 4.7% to 9.4% Co, 5.0% to 16.0% Mo, 0.5% to 4.0% W, 0.3% to 1.5% Al, 0.1% to 1.0% Ti, 0.001% to 0.15% C. Also, an Fe content of 5% by mass or less can prevent the high-temperature strength from being significantly reduced.

In the Ni-based alloy according to the present invention, a scrap material may be used as a raw material for the Ni-based alloy.

By making a scrap material usable, a sufficient amount of minor metals can be stably secured as the raw materials. In addition, depending on shapes of scrap materials, the melting can be sufficiently promoted and energy required for the melting can be reduced. If a scrap material is used, the mechanical properties, the machinability or the like can be prevented from being reduced because the nitrides can be evaluated at a high accuracy as described above.

The scrap material in the present invention includes a material prepared for other purposes than the raw material, a part made of the material, and other materials or parts generated during a process of producing the part, which have a variety of forms such as bulk, chip, and powder. Different scrap materials can be appropriately used in combination, and thus, a scrap material including a different concentration of an alloy element from the objective concentration thereof may be used, or an integrated scrap material including such scrap materials having the different concentrations, e.g., by welding, may be used.

In addition, a composition ratio of scrap materials is preferably 5% by mass or more because the contributions of scraps to stabilities of production, supply and price of materials becomes greater as the composition ratio of scraps becomes higher. When the composition ratio is further higher, the energy required for melting materials can be reduced and the melting time can be shortened, but scraps may contain unexpected component factors, and thus, the composition ratio is preferably 40% to 99% by mass.

In addition, titanium nitride is preferably applied as the nitrides.

Because Ti is a reactive element, nitride thereof can be easily formed. The titanium nitride has a polygonal shape in a cross-sectional view to greatly affect the mechanical properties, even if the particle size of titanium nitride is small. Accordingly, evaluating the largest size of titanium nitrides in a Ni-based alloy at a high accuracy by using the above-described method can securely improve the mechanical properties of the Ni-based alloy.

Furthermore, a Ni-based alloy for gas turbine combustor according to the present invention, which is used in a gas turbine combustor, is characterized to consist of the Ni-based alloy described above.

As discussed above, the Ni-based alloy according to the present invention has an excellent high-temperature corrosion resistance, excellent high-temperature strength properties such as creep property and creep fatigue, and an excellent workability and is particularly suitable as a material for a gas turbine combustor.

A member for a gas turbine combustor according to the present invention is characterized to be made of the Ni-based alloy for gas turbine combustor described above.

Because gas turbine combustors are used in high temperature environments, the high-temperature mechanical properties and the high-temperature corrosion resistance can be improved by constituting a gas turbine combustor with the Ni-based alloy for gas turbine combustor described above. Exemplary members for gas turbine combustor include materials for constituting parts of a gas turbine combustor such as plate materials and bar materials, casted and forged products having specific shapes, welded portions formed by welding these materials or products, welding rods, and the like.

A liner member for gas turbine combustor according to the present invention is characterized to be made of the Ni-based alloy for gas turbine combustor described above.

A transition piece member for gas turbine combustor according to the present invention is characterized to be made of the Ni-based alloy for gas turbine combustor described above.

A liner for gas turbine combustor according to the present invention is characterized to be made of the Ni-based alloy for gas turbine combustor described above.

A transition piece for gas turbine combustor according to the present invention is characterized to be made of the Ni-based alloy for gas turbine combustor described above.

Because the liner (inner cylinder) of the gas turbine combustor and the transition piece (tail pipe) are used particularly in high-temperature environments as described above, the life of the liner member, the transition piece member, the liner, and the transition piece can be extended by using the Ni-based alloy for gas turbine combustor described above.

Advantageous Effects of Invention

According to the present invention, there can be provided a Ni-based alloy with excellent high-temperature strength properties and high-temperature corrosion resistance, and a Ni-based alloy for gas turbine combustor, a member for gas turbine combustor, a liner member and a transition piece member for gas turbine combustor, and a liner and a transition piece for gas turbine combustor, each of which is made of the Ni-based alloy mentioned above.

DESCRIPTION OF EMBODIMENTS

Figure 1:
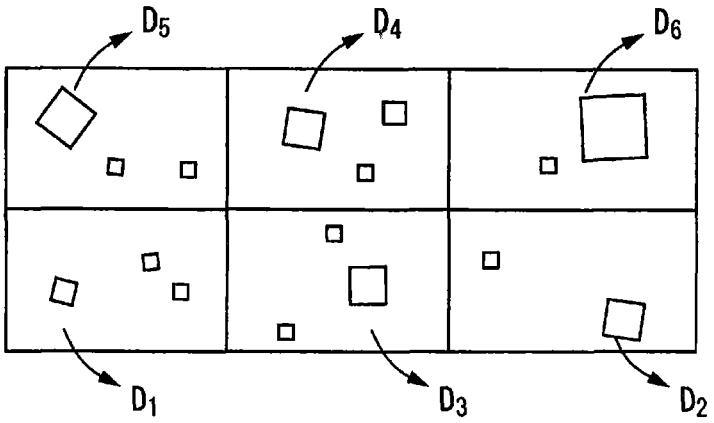
FIG. 1 is an explanatory view showing a process of selecting a nitride with the largest size within the field of view of microscopic observation in an embodiment of a Ni-based alloy according to the present invention.

An embodiment of a Ni-based alloy according to the present invention will be described below. The embodiment of a Ni-based alloy according to the present invention is used as a raw material for a member for gas turbine combustor, a liner member or transition piece member for gas turbine combustor, and a liner or transition piece for gas turbine combustor.

The Ni-based alloy according to the present embodiment has a composition consisting of, by mass, 20.0% to 26.0% Cr, 4.7% to 9.4% Co, 5.0% to 16.0% Mo, 0.5% to 4.0% W, 0.3% to 1.5% Al, 0.1% to 1.0% Ti, 0.001% to 0.15% C, at most 5% Fe, and the balance of Ni with inevitable impurities.

The reasons for the content ranges of the alloy elements mentioned above will be described below.

Cr

Cr is an element which has an effect for improving the high-temperature corrosion resistance such as a high-temperature oxidation or sulfurization resistance by forming an excellent protective film.

If the content of Cr is less than 20% by mass, sufficient high-temperature corrosion resistance cannot be secured. In contrast, if the content of Cr is more than 26% by mass, harmful phases such as a σ phase and μ phase may be precipitated, and thus, the high-temperature corrosion resistance may adversely reduce. To prevent this, the content of Cr is set within a range of 20.0% to 26.0% by mass.

Co

Co is an element which has an effect for improving the high-temperature strength properties such as the creep properties by solid solution strengthening with the matrix.

If the content of Co is less than 4.7% by mass, sufficient high-temperature strength properties cannot be imparted. In contrast, if the content of Co is more than 9.4% by mass, the hot workability may reduce and the high-temperature ductility during the use of the combustor may reduce. To prevent this, the content of Co is set within a range of 4.7% to 9.4% by mass.

Mo

Mo is an element which has an effect for improving the high-temperature strength properties such as the high-temperature tensile properties, the creep properties and the creep fatigue properties by solid solution strengthening with the matrix. The above-described effect is exhibited as a combined effect particularly in the presence of W.

If the content of Mo is less than 5.0% by mass, sufficient high-temperature ductility and creep fatigue properties cannot be imparted. In contrast, if the content of Mo is more than 16.0% by mass, the hot workability may reduce and harmful phases such as a μ phase may be precipitated, which may result in developing brittleness. To prevent this, the content of Mo is set within a range of 5.0% to 16.0% by mass.

W

W is an element which has an effect for improving the high-temperature strength properties such as the high-temperature tensile properties, the creep properties, and the creep fatigue properties by solid solution strengthening with the matrix. The above-described effect is exhibited as a combined effect particularly in the presence of Mo.

If the content of W is less than 0.5% by mass, sufficient high-temperature ductility and creep fatigue properties cannot be imparted. In contrast, if the content of W is more than 4.0% by mass, the hot workability may reduce and the ductility may also reduce, which is not preferable. To prevent this, the content of W is set within a range of 0.5% to 4.0% by mass.

Al

Al is an element which strengthens a solid solution with the matrix and forms a γ' phase ($Ni_3Al$) during the use of the combustor, and has an effect for improving the high-temperature strength properties such as the high-temperature tensile properties, the creep properties, and the creep fatigue properties. In a Ni-based alloy having such a γ' phase, nitride forms a harmful phase.

If the content of Al is less than 0.3% by mass, the degrees of the solid solution effect with the matrix and the precipitation of the γ' phase during the use may become insufficient, and thus, the desired high-temperature strength cannot be secured.

In contrast, if the content of Al is more than 1.5% by mass, the hot workability may reduce and the cold workability may also reduce, which is not preferable. To prevent this, the content of Al is set within a range of 0.3% to 1.5% by mass.

Ti

Ti is an element which strengthens a solid solution with the matrix and the γ' phase and has an effect for improving the high-temperature strength properties such as the high-temperature tensile properties, the creep properties, and the creep fatigue properties. Ti also has an effect for improving the grain boundary strength by forming a carbide, i.e., primarily an MC-type carbide, and an effect for preventing the growth of crystal grains, which may occur due to heating during hot working and solution heat treatment.

If the content of Ti is less than 0.1% by mass, the degrees of the solid solution effect with the matrix and the precipitation of the γ' phase during the use may become insufficient, and thus, the desired high-temperature strength cannot be secured; thus, the amount of carbide to be formed may be insufficient, and the desired effect for preventing the growth of crystal grains cannot be obtained. In contrast, if the content of Ti is more than 1.0% by mass, the hot workability may reduce and the tendency of generating coarse nitrides with titanium nitride and the carbide functioning as the core may increase, which is not preferable. To prevent this, the content of Ti is set within a range of 0.1% to 1.0% by mass.

C

C is an element which has an effect for improving the grain boundary strength by forming $M_6C$-type and MC-type carbides with Ti and Mo and an effect for preventing the growth of crystal grains which may occur due to heating during hot working and solution heat treatment.

If the content of C is less than 0.001% by mass, because the ratio of precipitation of the $M_6C$-type and MC-type carbides may become insufficient, a sufficient grain boundary strengthening function and a sufficient grain boundary pinning effect cannot be obtained. In contrast, if the content of C is more than 0.15% by mass, the carbides may be formed by an excessive constitutional quantity, and the hot workability, the weldability, and the ductility, and the like may reduce, and it may become easy for a coarse nitride to be formed with the MC-type carbide generated in the solidification process after the melting being the nucleation site of nitride, which is not preferable. To prevent this, the content of C is set within a range of 0.001% to 0.15% by mass.

Fe

Fe is an element which is easily entrained in a Ni-based alloy as an impurity element. If the content of Fe is more than 5% by mass, the high-temperature strength may dramatically reduce, which is not preferable. To prevent this, it is necessary to limit the content of Fe to 5% by mass or less.

Because Fe is inexpensive and economical and has an effect for improving the hot workability, Fe can also be added within a range of 0.01% to 5% by mass, optionally.

In addition to the above-described elements, the composition of the present embodiment of Ni-based alloy may further contain one or more elements selected from the group consisting of, by mass, 0.0005% to 0.05% Ca, 0.0005% to 0.05% Mg, 0.001% to 0.15% a rare earth element, 0.01% to 1.0% Nb, 0.01% to 1.0% Ta, 0.01% to 1.0% V, 0.002% to 0.01% B, and 0.001% to 0.05% Zr, optionally.

Ca and Mg are elements that have an effect for improving the hot workability and the cold workability.

The rare earth elements such as Y, Ce, and La are elements that have an effect for improving the oxidation resistance and the hot workability.

Nb, Ta, and V are elements that have an effect for forming carbides and preventing the growth of crystal grains which may occur due to heating during hot working and solution heat treatment.

B is an element which has an effect for improving the creep strength by forming a boride and strengthening the grain boundary.

Zr is an element which has an effect for improving the ductility of the grain boundary by segregating on the grain boundary.

To obtain such an effect, it is preferable to add the respective types of elements within the above-described ranges.

Furthermore, the composition of the present embodiment of Ni-based alloy may contain 1% by mass or less of Mn, 1% by mass or less of Si, 0.015% by mass or less of P, 0.015% by mass or less of S, or 0.5% by mass or less of Cu.

The above-described various characteristics can also be maintained when these elements are contained within the above-described ranges.

In the present embodiment of Ni-based alloy, an estimated largest size of nitrides is an area-equivalent diameter of 12 μm to 25 μm. The estimated largest size of nitrides is determined by calculating an area-equivalent diameter D which is defined as $D=A^{1/2}$ in relation to an area A of a nitride with a largest size among nitrides present in a measurement field of view area $S_0$ of an observation of the Ni-based alloy, repeatedly performing this operation for n times corresponding to a measurement field of view number n to acquire n pieces of data of the area-equivalent diameter D, arranging the pieces of data of area-equivalent diameter D in ascending order into $D_1, D_2, \ldots D_n$ to calculate a standardized variable $y_j$ which is defined by the following expression:

$$y_j=-\ln[-\ln\{j/(n+1)\}] \quad \text{[Expression 3]}$$

wherein j denotes the number of the arranged ascending order of the data of the area-equivalent diameter D, plotting the area-equivalent diameter D and the standardized variable $y_j$ on X and Y axes of an X-Y coordinate system, respectively, to obtain a regression line $y_j=a\times D+b$ (wherein a and b are constants), calculating $y_j$ from the following expression:

$$y_j=-\ln\left(-\ln\frac{S}{S_0+S}\right) \quad \text{[Expression 4]}$$

where a cross-sectional area to be predicted S is 100 $mm^2$, and substituting the obtained value of $y_j$ into the regression line to obtain the estimated largest size of the nitrides.

In the present embodiment, the nitrides are mostly titanium nitrides.

The method of estimating the estimated largest size of nitrides described above will be described below with reference to FIGS. 1 and 2.

First, the measurement field of view area $S_0$ for microscopy is set and the nitrides in this measurement field of view area $S_0$ are observed. In this operation, the observation magnification is preferably 400 to 1,000 times. Then, as shown in FIG. 1, a nitride with maximum size among nitrides observed in the measurement field of view area $S_0$ are selected. In order to measure the size at a high accuracy, the elected nitride is magnified, the area A of the selected nitride is measured, and the area-equivalent diameter $D=A^{1/2}$ is calculated. In this operation, the observation magnification is preferably 1,000 to 3,000 times.

The observation of the nitrides is carried out at the magnification of 400 to 1,000 times for preferably 30 or more measurement fields of view, more preferably 50 or more, as the measurement field of view number n. For the measurement of the area of the nitrides, it is preferable to carry out the measurement by a method in which the luminance distribution is acquired by using image processing, a threshold for the luminance is determined, and the nitrides, the matrix phase, the carbides, and the like are separated. In this measurement, color difference (RGB) may be used in substitution for the luminance. Particularly if the carbides recited in Patent Document 3 exist, they may be hardly distinguished from nitrides by using the luminance only, and it is thus preferable to separate between them by color difference (RGB). Test pieces used for the observation were observed with a scanning electron microscope and analyzed by using an energy dispersive X-ray analyzer (EDS) equipped to the scanning electron microscope, and thus, it was verified that the nitrides were titanium nitride.

This operation is repeatedly carried out for n times corresponding to the measurement field of view number n to obtain n pieces of data of the area-equivalent diameter D. Then the n pieces of the area-equivalent diameter D are arranged in ascending order of the area-equivalent diameter to obtain data $D_1, D_2, \ldots D_n$.

Then the standardized variable $y_j$ defined by the following expression is calculated by using the data $D_1, D_2, \ldots D_n$:

$$y_j=-\ln[-\ln\{j/(n+1)\}] \quad \text{[Expression 5]}$$

(where j denotes the number of the arranged ascending order of the data of the area-equivalent diameter D).

Figure 2:
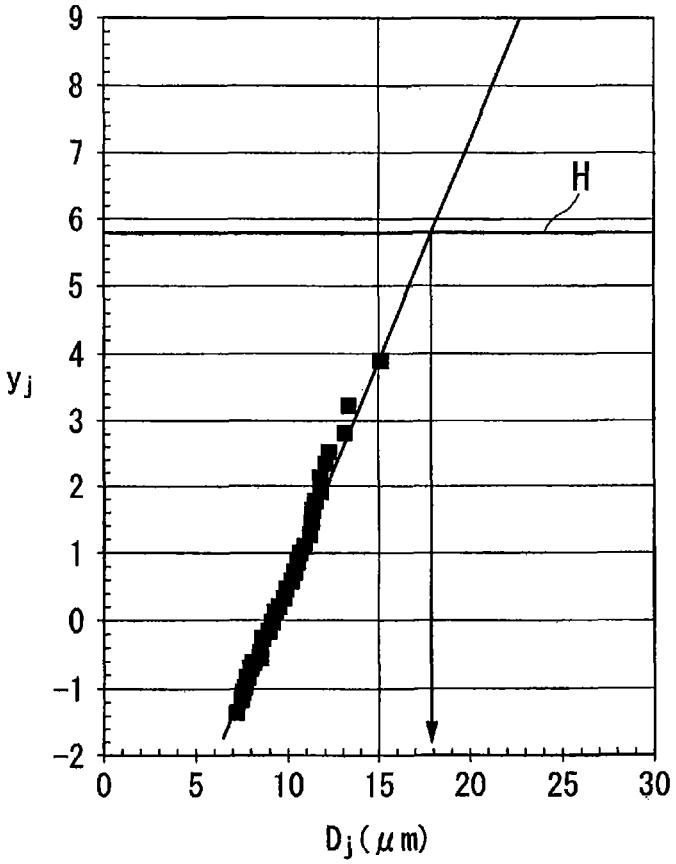
FIG. 2 is a graph showing a result of plotting area-equivalent diameters and standardized variables of nitrides on an X-Y coordinate system in an embodiment of a Ni-based alloy according to the present invention.

Then, as shown in FIG. 2, the data $D_1, D_2, \ldots D_n$ of the n area-equivalent diameters and the values of the standardized variables $y_1, y_2, \ldots y_n$ corresponding to these pieces of data are plotted on an X-axis and a Y-axis of an X-Y coordinate system, respectively.

A regression line $y_j=a\times D+b$ (a, b are constants) is obtained by the plotted graph.

Then, the solution to $y_j$ is calculated by the following expression. In this case, a cross-sectional area to be predicted S is 100 $mm^2$.

$$y_j=-\ln\left(-\ln\frac{S}{S_0+S}\right) \quad \text{[Expression 6]}$$

Specifically, in the graph shown in FIG. 2, the value of $D_j$ of the regression line for the value of $y_j$ corresponding to the cross-sectional area to be predicted S (a straight line H in FIG. 2) is the estimated largest size of nitrides, and the estimated largest size of nitrides is set within a range of 12 μm to 25 μm.

An embodiment of a method for producing a Ni-based alloy according to the present invention will be described below.

First, the melting raw materials are mixed and the mixture of the raw materials is pickled, and the melting is carried out in a vacuum melting furnace. A variety of scrap materials are used as the melting raw materials. In this stage, a reactive metal such as Al and Ti is preferably added so that the resulting concentration thereof is lower than the objective concentration thereof.

In the present embodiment, the scrap materials include a material prepared for other purposes than the raw material, a part made of the material, and other materials or parts generated during a process of producing the part, which have a variety of forms such as bulk, chip, and powder. Different scrap materials can be appropriately used in combination, and thus, a scrap material including a different concentration of an alloy element from the objective concentration thereof may be used, or an integrated scrap material including such scrap materials having the different concentrations, e.g., by welding, may be used.

In addition, a composition ratio of scrap materials is preferably 5% by mass or more because the contributions of scraps to stabilities of production, supply and price of materials becomes greater as the composition ratio of scraps becomes higher. When the composition ratio is further higher, the energy required for melting materials can be reduced and the melting time can be shortened, but scraps may contain unexpected component factors, and thus, the composition ratio is preferably 40% to 99% by mass.

Before starting the melting, the atmosphere inside the furnace is substituted with high-purity argon for 3 times or more, evacuation is carried out, and then the temperature of the inside of the furnace is raised. Then, after the molten metal is held for a predetermined time, the reactive metals Ti and Al are added into the molten metal. The resulting mixture is held for a predetermined time and then is discharged into a mold to obtain an ingot. From a point of view of preventing coarsening of the nitrides, the addition of Ti is preferably carried out as soon as possible before the discharge of the mixture.

This ingot is then subjected to hot forging to produce a hot forging not including a cast structure. Further, hot rolling is carried out to shape the hot forging into a hot rolled plate, and then solution heat treatment is performed on the hot rolled plate. The Ni-based alloy according to the present embodiment is produced by the above-described processes.

In the Ni-based alloy produced by the above-described production method, the concentration of the nitrogen in the Ni-based alloy is low, and the time of holding the reactive element of Ti at high-temperatures is short, and thus, generation and growth of titanium nitride can be prevented. With this configuration, as described above, the estimated largest size of the nitride (titanium nitride) becomes 12 μm to 25 μm when the cross-sectional area to be predicted S satisfies the expression: $S=100\ mm^2$.

According to the Ni-based alloy of the present embodiment having the configuration described above, the estimated largest size of the nitride when the cross-sectional area to be predicted S is 100 $mm^2$ is 25 μm or less by the area-equivalent diameter $D_j$, and thus, no large-size nitride exists in the inside of the Ni-based alloy, which thereby enables improvement of mechanical properties of the Ni-based alloy.

In addition, because the estimated largest size of the nitride when the cross-sectional area to be predicted S is 100 $mm^2$ is 12 μm or more by the area-equivalent diameter $D_j$, great increase in the production costs for the Ni alloy according to the present embodiment can be avoided, which enables industrial production of the Ni-based alloy.

In particular, in the present embodiment, the reactive element of Ti is contained and the nitride is titanium nitride. Because titanium nitride has a polygonal shape in a cross-sectional view, even if the particle size of titanium nitride is small, the mechanical properties may be greatly affected. Accordingly, the mechanical properties of the Ni-based alloy can be securely improved by evaluating the largest size of titanium nitride in the Ni-based alloy at a high accuracy by using the above-described method.

In addition, the Ni-based alloy according to the present embodiment has a composition including, by mass, 20.0% to 26.0% Cr, 4.7% to 9.4% Co, 5.0% to 16.0% Mo, 0.5% to 4.0% W, 0.3% to 1.5% Al, 0.1% to 1.0% Ti, 0.001% to 0.15% C, and at most 5% Fe, and thus has excellent high-temperature corrosion resistance, excellent high-temperature strength properties such as creep properties and creep fatigue, and excellent workability, and thus, the Ni-based alloy according to the present embodiment is suitable for use as a raw material for a variety of members of gas turbine combustors.

Further, in the Ni-based alloy according to the present embodiment, scraps are used as the melting raw materials, and thus raw materials such as minor metals can be stably secured. In addition, by appropriately selecting the shapes and the like of the scraps, melting can be sufficiently promoted and the energy required for the melting can be reduced. If scraps are used, evaluation of the nitrides can be performed at a high accuracy as described above, and thus degradation of mechanical properties, machinability, and the like can be prevented.

The Ni-based alloy according to the present embodiment is as described above; however, the present invention is not limited to this, and can be appropriately modified or altered within a scope not deviating from the technical concept of the present invention.

In addition, the production method of this Ni-based alloy is not limited to the examples described above with reference to the embodiment and may be produced by other production methods. For example, the Ni-based alloy can be produced by performing the melting in a vacuum atmosphere and continuous casting. To produce the Ni-based alloy of the present invention, the results of evaluation of the nitrides by the above-described method may show that the estimated largest size of the nitride when the cross-sectional area to be predicted S is 100 $mm^2$ is within a range of 12 μm or more and 25 μm or less by the area-equivalent diameter.

For example, a method may be employed in which a high-purity Ar gas is bubbled into the molten metal melted inside a vacuum melting furnace to reduce the concentration of nitrogen in the molten metal, and then reactive elements such as Ti are added.

Alternatively, another method may be employed in which the pressure in the inside of a chamber of a vacuum melting furnace is reduce, then a high-purity Ar gas is introduced into the chamber, and thus, the pressure in the inside of the chamber is controlled to be positive to prevent outside air from entering the chamber, and in this state, reactive elements such as Ti are added before the melting.

As described above, scraps are used as the melting raw material; however, the melting raw material is not limited thereto.

EXAMPLES

The results of the verification tests performed to verify the effects of the present invention will be described below.

Examples 1 to 12 of the Present Invention

Alloys of Examples 1 to 11 shown in Table 1 were melted by vacuum melting in an induction melting furnace to produce ingots with a diameter of 100 mm and a height of 150 mm by casting. An alloy of Example 12 of the present invention was melted by atmospheric melting in the induction melting furnace to produce an ingot with the same size as the above-mentioned examples by casting. These ingots were hot-forged to produce hot-forgings with the dimensions having a thickness of 50 mm, a width of 120 mm, and a length of 200 mm. The hot-forgings were further hot-rolled to produce hot-rolled plates having a thickness of 5 mm, which were subjected to a solution heat treatment, in which the plates were held at the temperature of 1,180° C. for 15 minutes and then were water-cooled.

The alloys having the composition ratio of scrap was 35% by mass or less, as shown in Table 1, were melted in the following manners.

Virgin raw materials such as Ni, Cr, Co, Mo and the like, except Al and Ti, and scrap materials having the average composition satisfying the chemical composition range defined in claim 1 were pickled and charged into an MgO crucible at the composition ratios shown in Table 1. After the raw materials were charged, the atmosphere of the inside of the furnace was evacuated before starting the melting, substitution with argon in which up to 0.5 atm of high-purity argon was introduced was repeated 3 times or more, then evacuation was performed, the temperature of the inside of the furnace was raised, and the melting at 1,450° C. was performed. After 10 minutes had passed since melt-down, the reactive elements of Ti and Al were added.

The alloys having the composition ratio of scrap was 40% by mass or more, as shown in Table 1, were melted in the following manners.

Virgin raw materials such as Ni, Cr, Co, Mo and the like, except Al and Ti, and scrap materials including Al by the concentration less than 0.3% and Ti by the concentration less than 0.1% were pickled and charged into an MgO crucible at the composition ratios shown in Table 1. After the raw materials were charged, the atmosphere of the inside of the furnace was evacuated before starting the melting, substitution with argon in which up to 0.5 atm of high-purity argon was introduced was repeated 3 times or more, then evacuation was performed, the temperature of the inside of the furnace was raised, and the melting at 1,450° C. was performed. After 10 minutes had passed since melt-down, the reactive elements of Ti and Al were added.

For Example 12 of the present invention, scrap materials with the desired chemical composition range were serially charged in the furnace, the temperature of the inside of the furnace was raised, and casting was performed when the temperature inside the furnace had reached 1,450° C.

Comparative Examples 1 and 2

The alloys shown in Table 1 were melted by atmospheric melting in the induction melting furnace to produce ingots with a diameter of 100 mm and a height of 150 mm by casting. These ingots were hot-forged to produce hot-forgings with the dimensions having a thickness of 50 mm, a width of 120 mm, and a length of 200 mm. The hot-forgings were further hot-rolled to produce hot-rolled plates having a thickness of 5 mm, which were subjected to a solution heat treatment, in which the plates were held at the temperature of 1,180° C. for 15 minutes and then were water-cooled.

The alloys were melted in the following manners. Raw materials such as Ni, Cr, Co, Mo, Ti, Al and the like were charged into an MgO crucible without being pickled and then were melted. In this process, after the melt-down, the resultant was held at 1,500° C. for 10 minutes and then at 1,450° C. for 10 minutes.

Estimation of the Largest Size of Nitrides

By using the hot-rolled plates of Examples 1 to 12 of the present invention and the hot-rolled plates of Comparative Examples 1 and 2 obtained in the above-described manner, the estimation of the largest size of nitrides was performed by the following process.

Figure 3:
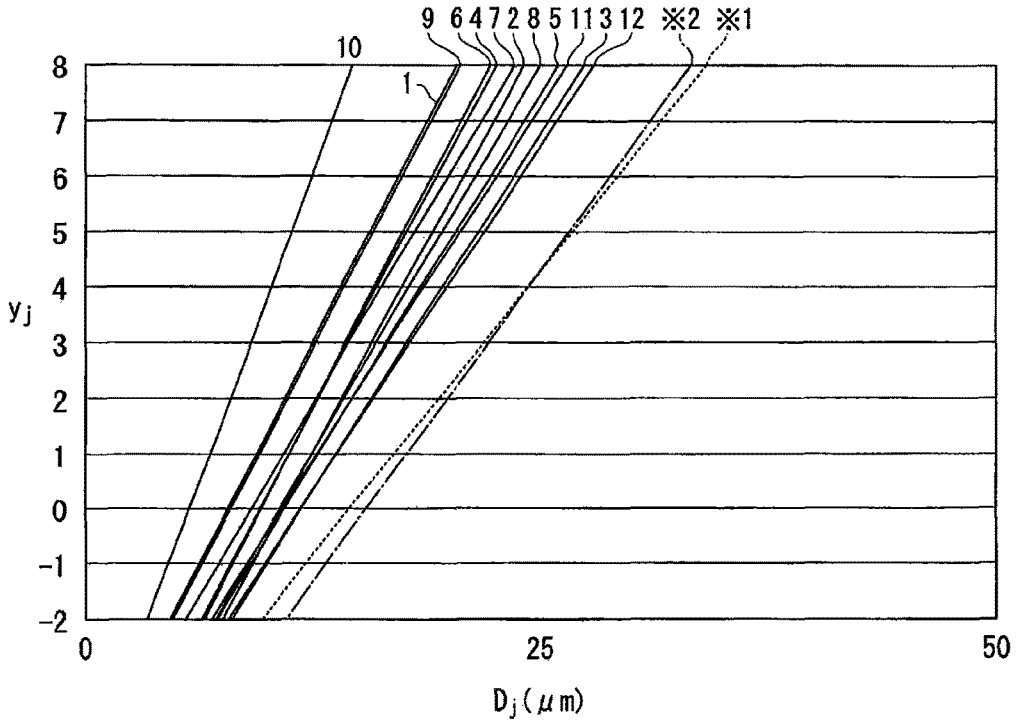
FIG. 3 is a graph showing a result of plotting area-equivalent diameters and standardized variables of nitride on an X-Y coordinate system in the examples.

Sample pieces for observation of the microstructure were cut out from the obtained plates, were polished, and then were observed by microscope. The estimated largest size of nitrides was determined by the above-described process, when the cross-sectional area to be predicted S satisfied the expression: $S=100\ mm^2$. In the present embodiment, the measurement field of view area $S_0$ satisfied the expression: $S_0=0.306\ mm^2$. The selection of the nitrides with the largest size within the measurement field of view area $S_0$ was carried out by observation at the magnification of 450 times, and the measurement of the area of the selected nitride was carried out by observation at the magnification of 1,000 times. The measurement field of view number n satisfied the expression: n=50. The estimated largest size of nitride is shown in Table 2. The regression lines obtained by plotting on the X-Y coordinate system are shown in FIG. 3.

Cutting Test

Cutting tests were carried out on the rolled surface of the obtained hot-rolled plates by using a ball-end mill constituted by hard metal under a solvent cutting oil environment and under the following conditions: revolution: 20,000 rpm, feeding rate: 1,400 mm/min, cutting rate: 188 mm/min, and axial cutting depth: 0.3 mm, and the cutting length obtained until the timing at which a chipping occurred on the cutting edge was measured. The results are shown in Table 2.

Low-Cycle Fatigue Test

Plate-like test pieces with the dimensions having a parallel portion width of 6.4 mm, a parallel portion thickness of 3 mm, and a parallel portion length of 16 mm were sampled from the obtained billets, and these test pieces were heated up to 700° C., tensile/compression total strain of 0.7% was repeatedly imparted, and thereby low-cycle fatigue tests were performed and the number of cycles performed up to a timing at which the peak stress on the tension side had reduced to ½ of the maximum value or a timing at which the test piece were broken. The results are shown in Table 2.

TABLE 1

| | | Chemical composition (% by mass) | | | | | | | | Composition ratio of scrap |
|---|---|---|---|---|---|---|---|---|---|---|
| | | Cr | Co | Mo | W | Al | Ti | C | Ni | (% by mass) |
| Examples of the present invention | 1 | 21.9 | 8.1 | 8.9 | 3.1 | 0.9 | 0.3 | 0.07 | Balance | 60 |
| | 2 | 20.0 | 4.7 | 16.0 | 0.5 | 0.3 | 0.6 | 0.03 | Balance | 5 |
| | 3 | 24.0 | 6.5 | 5.0 | 2.1 | 1.5 | 0.2 | 0.08 | Balance | 50 |
| | 4 | 25.9 | 9.4 | 8.1 | 4.0 | 1.1 | 0.2 | 0.06 | Balance | 70 |
| | 5 | 20.1 | 7.8 | 9.9 | 2.7 | 0.8 | 0.3 | 0.08 | Balance | 99 |
| | 6 | 22.1 | 7.9 | 9.4 | 2.8 | 1.2 | 0.1 | 0.09 | Balance | 80 |

TABLE 1-continued

| | | Chemical composition (% by mass) | | | | | | | | Composition ratio of scrap |
|---|---|---|---|---|---|---|---|---|---|---|
| | | Cr | Co | Mo | W | Al | Ti | C | Ni | (% by mass) |
| | 7 | 21.5 | 8.1 | 8.7 | 3.1 | 0.8 | 0.6 | 0.02 | Balance | 90 |
| | 8 | 20.9 | 7.0 | 8.3 | 2.1 | 0.6 | 1.0 | 0.01 | Balance | 25 |
| | 9 | 22.2 | 8.2 | 9.2 | 3.3 | 0.5 | 0.8 | 0.001 | Balance | 40 |
| | 10 | 22.4 | 8.0 | 8.8 | 2.9 | 1.3 | 0.1 | 0.15 | Balance | 55 |
| | 11 | 20.1 | 8.1 | 8.4 | 3.0 | 0.4 | 0.1 | 0.04 | Balance | 0 |
| | 12 | 22.1 | 7.9 | 8.5 | 2.8 | 0.5 | 0.3 | 0.06 | Balance | 100 |
| Comparative | 1 | 23.1 | 7.1 | 7.0 | 2.3 | 0.7 | 0.05 | 0.13 | Balance | 0 |
| Examples | 2 | 20.9 | 9.1 | 11.7 | 3.7 | 1.3 | 0.8 | 0.10 | Balance | 0 |

TABLE 2

| | | Estimated largest size of nitrides (μm) | Cutting length obtained by cutting test (m) | Number of cycles in low-cycle fatigue test (cycles) |
|---|---|---|---|---|
| Examples of the present invention | 1 | 17 | 34 | 1,717 |
| | 2 | 21 | 30 | 1,007 |
| | 3 | 24 | 29 | 1,018 |
| | 4 | 19 | 30 | 1,031 |
| | 5 | 22 | 28 | 1,669 |
| | 6 | 19 | 31 | 2,273 |
| | 7 | 19 | 33 | 1,521 |
| | 8 | 20 | 32 | 1,880 |
| | 9 | 16 | 36 | 4,167 |
| | 10 | 12 | 37 | 3,127 |
| | 11 | 23 | 28 | 1,124 |
| | 12 | 24 | 27 | 1,050 |
| Comparative Examples | 1 | 29 | 20 | 461 |
| | 2 | 28 | 22 | 430 |

In Comparative Examples 1 and 2 in which the estimated largest size of the nitrides when the cross-sectional area to be predicted S was 100 $mm^2$ exceeded 25 μm by the area-equivalent diameter, the cutting length reached before the timing at which chippings had occurred on the cutting edge in the cutting test was as short as 20 m and 22 m, and thus, it was observed that the machinability was low. In addition, in the low-cycle fatigue test, the number of cycles performed up to a timing at which the test pieces were broken was as small as 461 times and 430 times, and it was thus observed that the fatigue strength was low.

In contrast, in Examples 1 to 12 of the present invention in which the estimated largest size of the nitrides when the cross-sectional area to be predicted S was 100 $mm^2$ was a range of 12 μm to 25 μm, the cutting length reached before the timing at which chippings had occurred on the cutting edge in the cutting test was 27 m or longer, which was relatively long, and thus, it was observed that the machinability was high.

In addition, in the low-cycle fatigue test, the number of cycles performed up to a timing at which the test pieces were broken was as many as 1,007 times or more, and it was thus observed that the fatigue strength had been greatly improved. The same effects as those of Examples 1 to 10 of the present invention were observed also in Example 11 of the present invention in which the ratio of scrap was 0% and Example 12 in which atmospheric melting was performed.

As described above, according to the present invention, there can be provided a Ni-based alloy having excellent high-temperature strength properties and high-temperature corrosion resistance, of which the nitrides present in an inside can be appropriately and accurately evaluated.

The invention claimed is:

1. A Ni-based alloy having a composition comprising, by mass, 20.0% to 26.0% Cr, 4.7% to 9.4% Co, 5.0% to 16.0% Mo, 0.5% to 4.0% W, 0.3% to 1.5% Al, 0.1% to 1.0% Ti, 0.001% to 0.15% C, and at most 5% Fe and the balance of Ni with inevitable impurities, wherein the Ni-based alloy comprises titanium nitrides, of which an estimated largest size is an area-equivalent diameter of 12 μm to 25 μm, the estimated largest size of the titanium nitrides being determined by calculating an area-equivalent diameter D which is defined as $D=A^{1/2}$ in relation to an area A of a titanium nitride with a largest size among titanium nitrides present in a measurement field of view area $S_0$ of an observation of the Ni-based alloy, repeatedly performing this operation for n times corresponding to a measurement field of view number n to acquire n pieces of data of the area-equivalent diameter D, arranging the pieces of data of area-equivalent diameter D in ascending order into $D_1, D_2, \ldots D_n$ to calculate a standardized variable $y_j$ which is defined by the following expression:

$$y_j=-\ln[-\ln\{j/(n+1)\}] \quad \text{[Expression 1]}$$

wherein j denotes the number of the arranged ascending order of the data of the area-equivalent diameter D, plotting the area-equivalent diameter D and the standardized variable $y_j$ on X and Y axes of an X-Y coordinate system, respectively, to obtain a regression line $y_j=a\times D+b$ (wherein a and b are constants), calculating $y_j$ from the following expression:

$$y_j=-\ln\left(-\ln\frac{S}{S_0+S}\right) \quad \text{[Expression 2]}$$

where a cross-sectional area to be predicted S is 100 $mm^2$, and substituting the obtained value of $y_j$ into the regression line to obtain the estimated largest size of the titanium nitrides wherein $S_0$ equals 0.306 $mm^2$, n is greater than or equal to 30, and the observation of the Ni-based alloy is at an observation magnification of 400 to 1000 times or 1000 to 3000 times.

2. The Ni-based alloy according to claim 1, wherein a scrap material is used as a raw material for the Ni-based alloy.

3. A Ni-based alloy for a gas turbine combustor, which is used for a gas turbine combustor, the Ni-based alloy consisting of the Ni-based alloy according to claim 1.

4. A member for a gas turbine combustor, comprising the Ni-based alloy for gas turbine combustor according to claim 3.

5. A liner member for a gas turbine combustor, comprising the Ni-based alloy for gas turbine combustor according to claim 3.

6. A transition piece member for a gas turbine combustor, comprising the Ni-based alloy for gas turbine combustor according to claim 3.

7. A liner of a gas turbine combustor, comprising the Ni-based alloy for gas turbine combustor according to claim 3.

8. A transition piece of a gas turbine combustor, comprising the Ni-based alloy for gas turbine combustor according to claim 3.

9. A hot-rolled plate comprising the Ni-based alloy according to claim 1, wherein a content of Fe is 0.01% to 5% by mass.

* * * * *